US011646167B1

(12) United States Patent
Jhuang et al.

(10) Patent No.: US 11,646,167 B1
(45) Date of Patent: May 9, 2023

(54) KEYBOARD DEVICE AND KEY STRUCTURE THEREOF

(71) Applicant: Primax Electronics Ltd., Taipei (TW)

(72) Inventors: Chuang-Shu Jhuang, Taipei (TW); Dan Li, Taipei (TW); Sheng-Huang Huang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/711,757

(22) Filed: Apr. 1, 2022

(30) Foreign Application Priority Data

Mar. 17, 2022 (CN) ..... 202210265189.1

(51) Int. Cl.
*H01H 13/7065* (2006.01)
*H01H 3/12* (2006.01)

(52) U.S. Cl.
CPC ..... *H01H 13/7065* (2013.01); *H01H 3/125* (2013.01); *H01H 2231/002* (2013.01)

(58) Field of Classification Search
CPC ..... H01H 13/16; H01H 3/00; H01H 3/02; H01H 3/12; H01H 5/00; H01H 5/04; H01H 13/00; H01H 13/12; H01H 13/14; H01H 13/26; H01H 13/28; H01H 13/32; H01H 13/48; H01H 13/50; H01H 13/52; H01H 13/70; H01H 13/7006; H01H 13/702; H01H 13/705; H01H 2003/00; H01H 2003/02; H01H 2003/12; H01H 2013/00; H01H 2013/02; H01H 2013/50; H01H 3/125; H01H 13/7065
USPC ..... 200/294, 341, 344, 406, 513, 516
See application file for complete search history.

(56) References Cited

U.S. PATENT DOCUMENTS 3,999,025 A * 12/1976 Sims, Jr. ..... H01H 13/705 200/516
4,553,009 A * 11/1985 Van Zeeland ..... H01H 13/705 400/479
4,864,085 A * 9/1989 Hanajima ..... H01H 13/705 200/513
6,133,538 A * 10/2000 Hsu ..... H01H 3/125 200/344
2018/0358193 A1* 12/2018 Chen ..... H01H 11/06

* cited by examiner

*Primary Examiner* — Anthony R Jimenez
(74) *Attorney, Agent, or Firm* — Kirton McConkie; Evan R. Witt

(57) ABSTRACT

A keyboard device includes plural key structures. Each key structure includes a base plate, a keycap, a membrane circuit board, a connecting member and an elastic element. The keycap includes a pressing post. The membrane circuit board is arranged between the base plate and the keycap. The connecting member is penetrated through the membrane circuit board and connected between the keycap and the base plate. The keycap is movable upwardly or downwardly relative to the membrane circuit board. The elastic element is arranged between the keycap and the membrane circuit board. The elastic element includes a resilience piece and plural supporting ribs. The plural supporting ribs are arranged between the resilience piece and the keycap. The plural supporting ribs are contacted with the pressing post of the keycap. Consequently, there is a gap between the pressing post and the resilience piece.

10 Claims, 6 Drawing Sheets

KEYBOARD DEVICE AND KEY STRUCTURE THEREOF

FIELD OF THE INVENTION

The present invention relates to an input device, and more particularly to a keyboard device and a key structure of the keyboard device.

BACKGROUND OF THE INVENTION

With increasing development of science and technology, a variety of electronic devices are designed in views of convenience and user-friendliness. For helping the users well operate the electronic devices, the electronic devices are gradually developed in views of humanization. The input devices of the common electronic devices include for example mouse devices, keyboard devices, trackball devices, or the like. Via the keyboard device, texts or symbols can be inputted into the computer system directly. As a consequence, most users and most manufacturers of input devices pay much attention to the development of keyboard devices.

Generally, a keyboard device comprises plural key structures. Each key structure comprises a keycap, a scissors-type connecting member, a membrane circuit board and a base plate. These components are stacked on each other sequentially. In case that the keyboard device is a luminous keyboard device, the keyboard device is equipped with a backlight module under the base plate.

Moreover, a membrane switch is installed on the membrane circuit board, and an elastic element (e.g., a rubber dome) is arranged between the keycap and the membrane circuit board. The scissors-type connecting member is connected between the keycap and the base plate. Moreover, the scissors-type connecting member comprises a first frame and a second frame. The second frame is pivotally coupled to the first frame. Consequently, the first frame and the second frame can be swung relative to each other.

While the keycap of any key structure is pressed down and moved downwardly relative to the base plate, the first frame and the second frame of the scissors-type connecting member are switched from an open-scissors state to a stacked state. Moreover, as the keycap is moved downwardly to compress the elastic element, the corresponding membrane switch is pushed and triggered by the elastic element. Consequently, the keyboard device generates a corresponding key signal.

When the keycap of the key structure is no longer pressed, the keycap is moved upwardly relative to the base plate in response to an elastic force of the elastic element. Meanwhile, the first frame and the second frame are switched from the stacked state to the open-scissors state, and the keycap is returned to its original position.

However, even if the rubber-dome elastic element is not compressed, the rubber-dome elastic element has a bulky volume. In case that the key structure of the keyboard is equipped with the rubber-dome elastic element, the production of the keyboard is limited by the material of the component. Under this circumstance, it is difficult to reduce the overall volume of the key structure or fabricate the slim-type keyboard.

For solving the above drawbacks, a metal-dome elastic element is used as a restoring mechanism. The metal-dome elastic element is made of stainless steel or copper. In comparison with the rubber-dome elastic element, the volume or thickness of the metal-dome elastic element is reduced. Consequently, the overall volume of the key structure is reduced, and the keyboard device is slim.

Although the volume or thickness of the metal-dome elastic element is reduced, some drawbacks occur. For example, when the metal-dome elastic element is compressed by the keycap, the travel distance is very short. Consequently, the tactile feel of depressing the metal-dome elastic element is usually unsatisfied to the user.

Therefore, there is a need of providing an improved keyboard device and an associated key structure in order to overcome the drawbacks of the conventional technologies.

SUMMARY OF THE INVENTION

The present invention provides a keyboard device and a key structure with enhanced operating feel.

The other objects and advantages of the present invention will be understood from the disclosed technical features.

In accordance with an aspect of the present invention, a keyboard device is provided. The keyboard device includes plural key structures. Each of the plural key structures includes a base plate, a keycap, a membrane circuit board, a connecting member and an elastic element. The keycap is located over the base plate. The keycap includes a pressing post. The pressing post is protruded in a direction toward the base plate. The membrane circuit board is arranged between the base plate and the keycap. The connecting member is penetrated through the membrane circuit board and connected between the keycap and the base plate. The keycap is movable upwardly or downwardly relative to the membrane circuit board through the connecting member. The elastic element is arranged between the keycap and the membrane circuit board. The elastic element includes a resilience piece and plural supporting ribs. The plural supporting ribs are arranged between the resilience piece and the keycap. The plural supporting ribs are protruded in a direction toward the keycap and contacted with the pressing post of the keycap. Consequently, there is a gap between the pressing post and the resilience piece.

In an embodiment, while the keycap is pressed down in response to an external force, the pressing post is moved downwardly to push the plural supporting ribs of the elastic element, and the plural supporting ribs are subjected to deformation. Consequently, the keycap is moved toward the membrane circuit board and moved from a first position to a second position.

In an embodiment, as the keycap is continuously pressed in response to the external force, the resilience piece of the elastic element is continuously pushed by the pressing post, and the resilience piece is subjected to deformation. Consequently, the keycap is moved toward the membrane circuit board and moved from the second position to a third position.

In an embodiment, the plural supporting ribs of the elastic element include two supporting ribs, and the two supporting ribs are located at two opposite sides of the resilience piece.

In an embodiment, the plural supporting ribs of the elastic element include four supporting ribs. The four supporting ribs face each other in pairs. The four supporting ribs are discretely arranged on edges of the resilience piece.

In an embodiment, each of the plural supporting ribs of the elastic element includes a supporting part and a carrying part. The supporting part is connected between the resilience piece and the carrying part. The carrying part is arranged between the pressing post of the keycap and the resilience piece. The pressing post of the keycap is carried by the carrying part.

In an embodiment, the plural supporting ribs of the elastic element are integrally formed with the resilience piece, and each of the plural supporting ribs are bent upwardly from a portion of the resilience piece.

In an embodiment, the resilience piece of the elastic element has a semi-spheric shell structure, and the semi-spheric shell structure has a cavity facing the membrane circuit board.

In an embodiment, the keycap includes a top wall and a skirt part. The skirt part is protruded from a periphery region of the top wall in a direction toward the membrane circuit board. The pressing post of the keycap is installed on an inner surface of the top wall.

In an embodiment, the key structure further includes a stabilizer bar, and the stabilizer bar includes a transverse bar part and two locking parts. The two locking parts are respectively located at two ends of the transverse bar part. The transverse bar part is pivotally coupled to the keycap. The two locking parts are connected with the base plate.

In accordance with another aspect of the present invention, a key structure is provided. The key structure includes a base plate, a keycap, a membrane circuit board, a connecting member and an elastic element. The keycap is located over the base plate. The keycap includes a pressing post. The pressing post is protruded in a direction toward the base plate. The membrane circuit board is arranged between the base plate and the keycap. The connecting member is penetrated through the membrane circuit board and connected between the keycap and the base plate. The keycap is movable upwardly or downwardly relative to the membrane circuit board through the connecting member. The elastic element is arranged between the keycap and the membrane circuit board. The elastic element includes a resilience piece and plural supporting ribs. The plural supporting ribs are arranged between the resilience piece and the keycap. The plural supporting ribs are protruded in a direction toward the keycap and contacted with the pressing post of the keycap. Consequently, there is a gap between the pressing post and the resilience piece.

From the above descriptions, the present invention provides the keyboard device. The elastic element of each key structure is equipped with plural supporting ribs for supporting the keycap. Consequently, the travel distance of moving the keycap in the direction toward the membrane circuit board is increased. Moreover, while the keycap is moved downwardly, an empty travel distance is generated to provide a buffering effect. Consequently, the tactile feel of depressing the key structure is satisfactory to the user. In comparison with the conventional technology of using the elastic element with small volume or thickness, the tactile feel of operating the key structure of the present invention is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
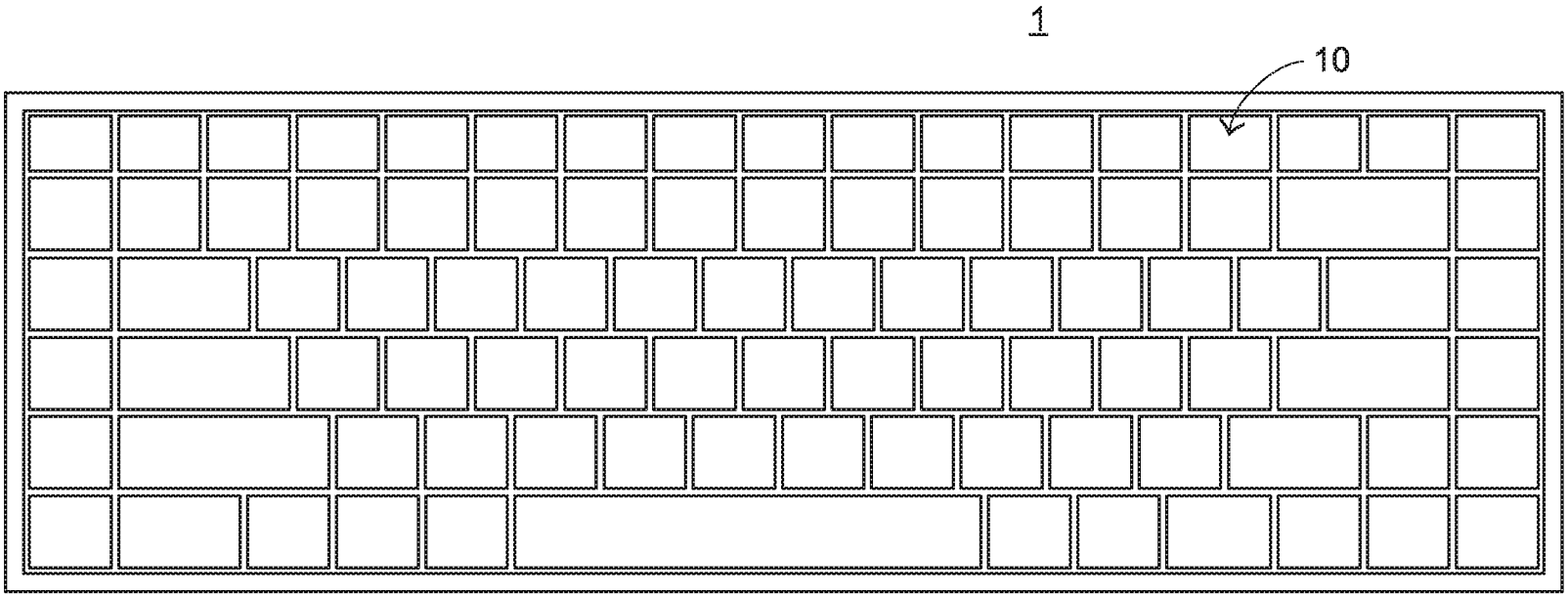
FIG. 1 is a schematic top view illustrating the outer appearance of a keyboard device according to an embodiment of the present invention.
Figure 2:
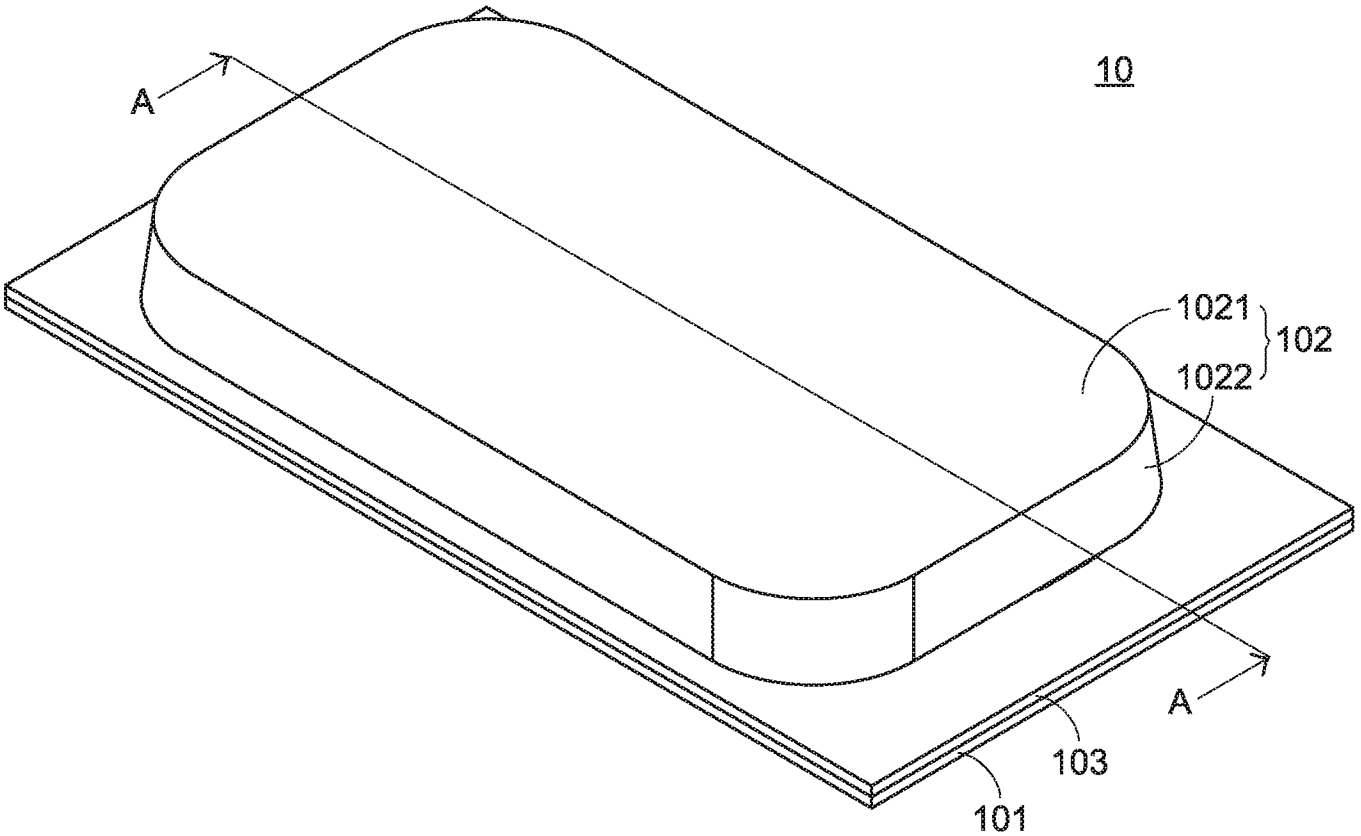
FIG. 2 is a schematic perspective view illustrating a portion of a key structure of the keyboard device as shown in FIG. 1.
Figure 3:
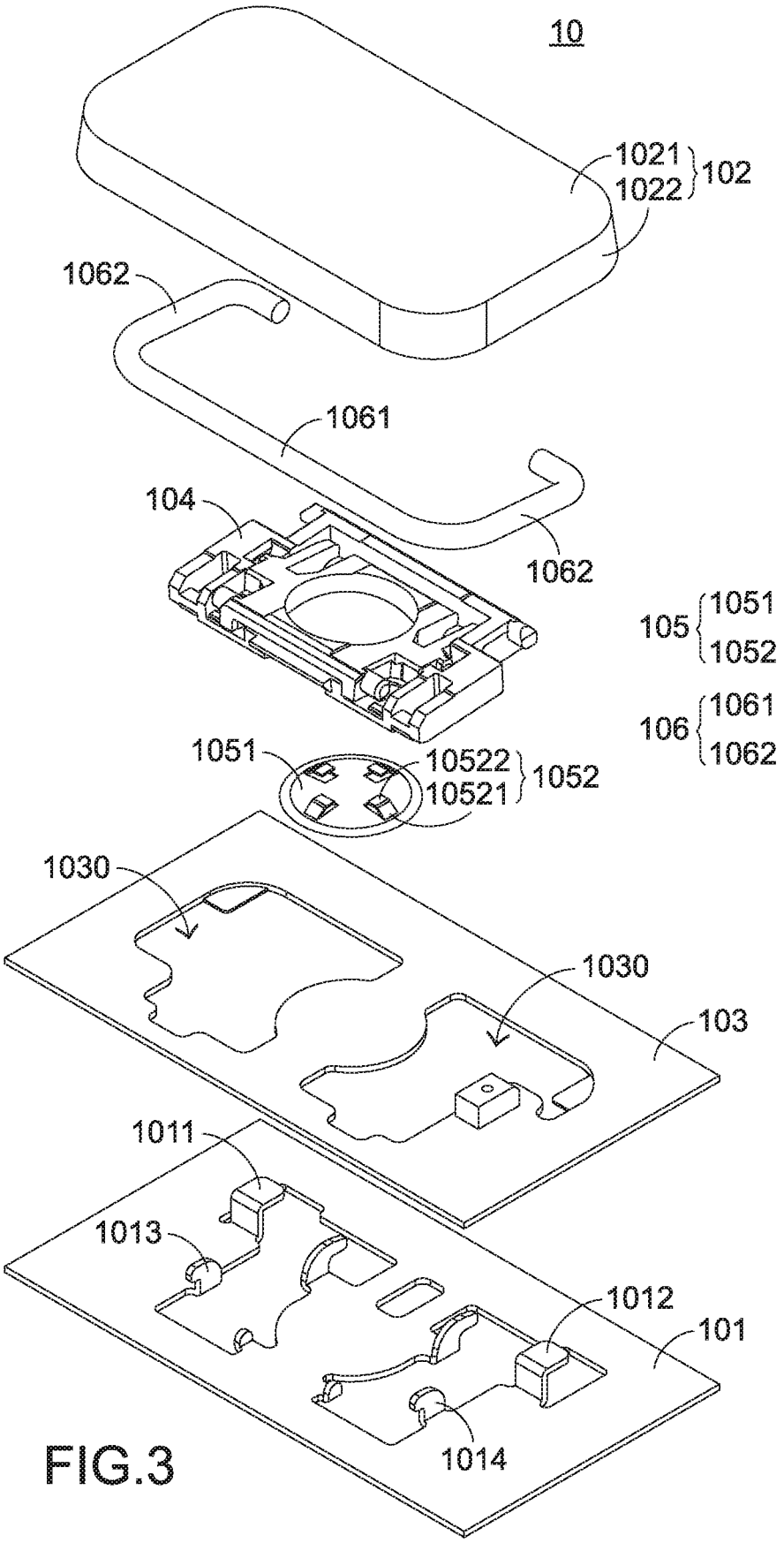
FIG. 3 is a schematic exploded view illustrating the key structure as shown in FIG. 2 and taken along a viewpoint.
Figure 4:
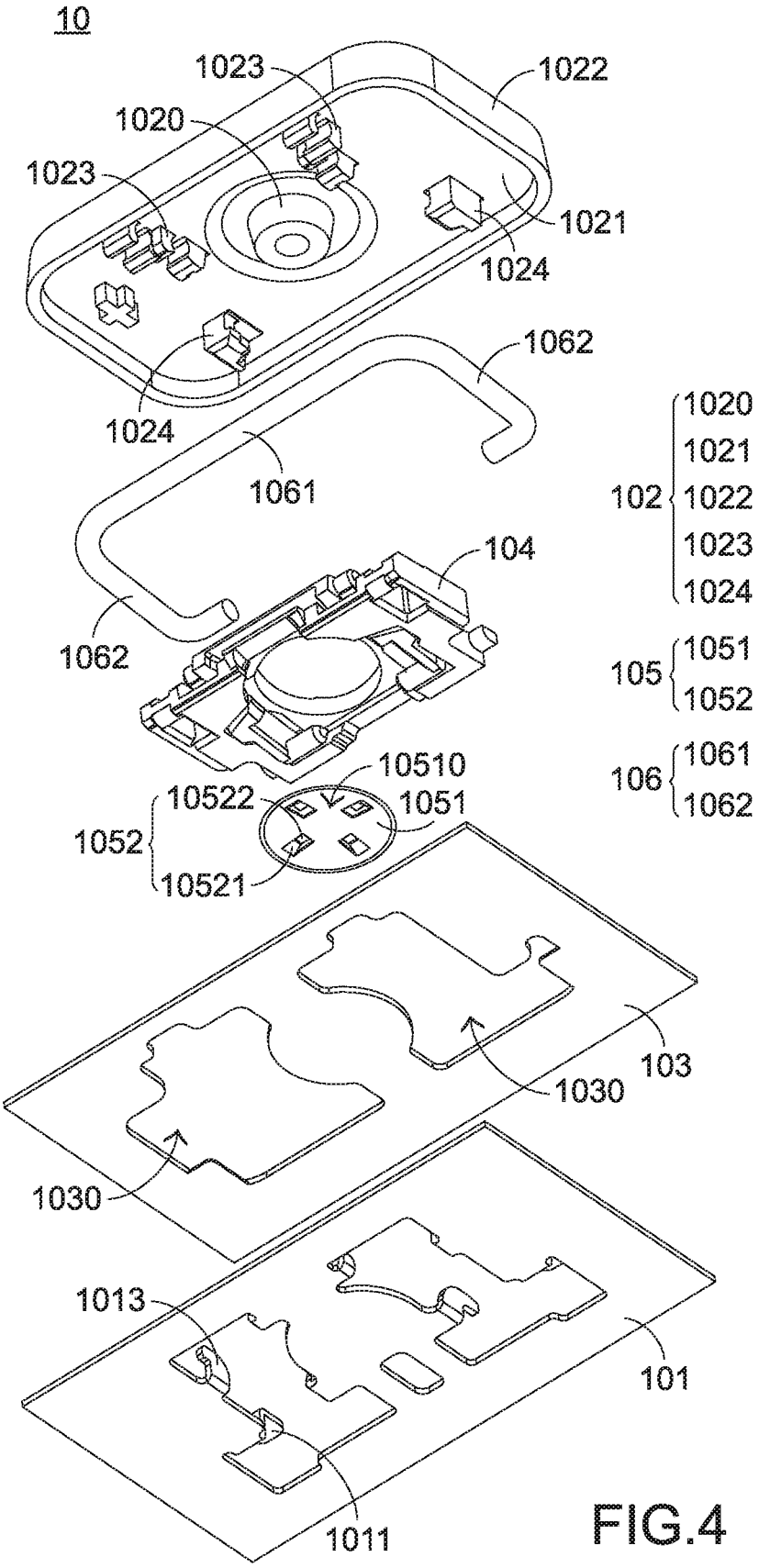
FIG. 4 is a schematic exploded view illustrating the key structure as shown in FIG. 2 and taken along another viewpoint.
Figure 5:
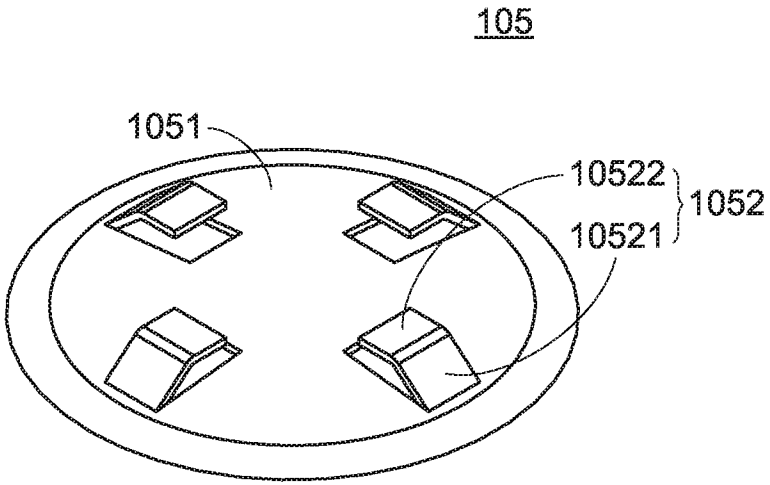
FIG. 5 is a schematic perspective view illustrating the elastic element of the key structure as shown in FIGS. 3 and 4.
Figure 6:
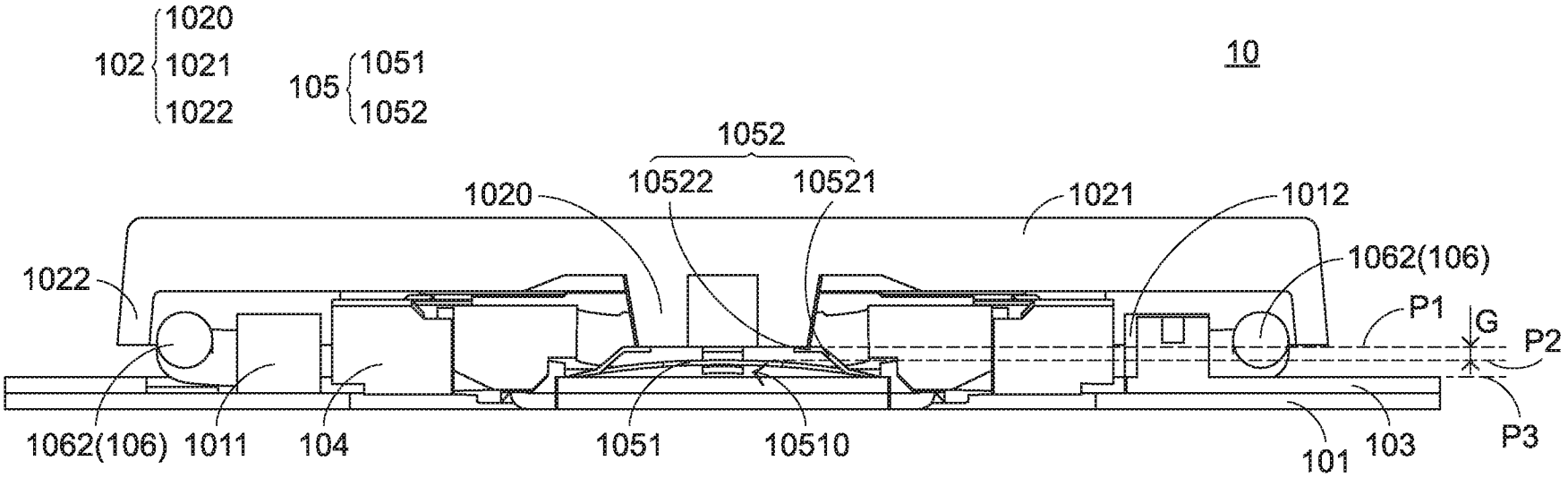
FIG. 6 is a schematic cross-sectional view illustrating the key structure as shown in FIG. 2 and taken along the line AA.

Please refer to FIGS. 1, 2, 3, 4, 5 and 6. FIG. 1 is a schematic top view illustrating the outer appearance of a keyboard device according to an embodiment of the present invention. FIG. 2 is a schematic perspective view illustrating a portion of a key structure of the keyboard device as shown in FIG. 1. FIG. 3 is a schematic exploded view illustrating the key structure as shown in FIG. 2 and taken along a viewpoint. FIG. 4 is a schematic exploded view illustrating the key structure as shown in FIG. 2 and taken along another viewpoint. FIG. 5 is a schematic perspective view illustrating the elastic element of the key structure as shown in FIGS. 3 and 4. FIG. 6 is a schematic cross-sectional view illustrating the key structure as shown in FIG. 2 and taken along the line AA. For succinctness, only a single key structure and associated components are shown in FIGS. 2, 3, 4, 5 and 6.

As shown in FIG. 1, the keyboard device 1 comprises plural key structures 10. These key structures 10 are classified into some types, e.g., ordinary keys, numeric keys and function keys. When one of the key structures 10 is pressed down by the user's finger, the keyboard device 1 generates a corresponding key signal to a computer, and thus the computer executes a corresponding function. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The key structure 10 of the keyboard device 1 will be described in more details as follows.

Please refer to FIGS. 2, 3, 4, 5 and 6. In an embodiment, the key structure 10 comprises a base plate 101, a keycap 102, a membrane circuit board 103, a connecting member 104 and an elastic element 105.

The keycap 102 is located over the base plate 101. The keycap 102 comprises a pressing post 1020. The pressing post 1020 is protruded in the direction toward the base plate 101.

The membrane circuit board 103 is arranged between the base plate 101 and the keycap 102.

The connecting member 104 is penetrated through the membrane circuit board 103 and connected between the keycap 102 and the base plate 101. Moreover, the keycap 102 is movable upwardly or downwardly relative to the membrane circuit board 103 through the connecting member 104.

The elastic element 105 is arranged between the keycap 102 and the membrane circuit board 103. In an embodiment, the elastic element 105 comprises a resilience piece 1051 and plural supporting ribs 1052. These supporting ribs 1052 are arranged between the resilience piece 1051 and the keycap 102. Each supporting rib 1052 is protruded in the direction toward the keycap 102 and contacted with the pressing post 1020 of the keycap 102. Consequently, there is a gap G between the pressing post 1020 and the resilience piece 1051.

Please refer to FIGS. 2, 3, 4, 5 and 6 again. In an embodiment, the keycap 102 comprises a top wall 1021 and a skirt part 1022. The skirt part 1022 of the keycap 102 is protruded from a periphery region of the top wall 1021 in the direction toward the membrane circuit board 103. In an embodiment, the pressing post 1020 of the keycap 102 is installed on an inner surface of the top wall 1021 that faces the membrane circuit board 103. In addition, the pressing post 1020 is disposed within an accommodation space that is defined by the top wall 1021 and the skirt part 1022 collaboratively.

Please refer to FIGS. 3, 4 and 6 again. In an embodiment, the key structure 10 further comprises a stabilizer bar 106. The stabilizer bar 106 comprises a transverse bar part 1061 and two locking parts 1062. The two locking parts 1062 are located at two ends of the transverse bar part 1061, respectively. The transverse bar part 1061 of the stabilizer bar 106 is pivotally coupled to the keycap 102. The two locking parts 1062 of the stabilizer bar 106 are connected with the base plate 101.

The base plate 101 comprises a first hook 1011 and a second hook 1012. The first hook 1011 and the second hook 1012 are protruded upwardly and penetrated through the membrane circuit board 103. The keycap 102 further comprises plural first pivotal parts 1023. Particularly, the transverse bar part 1061 of the stabilizer bar 106 is pivotally coupled to the plural first pivotal parts 1023 of the keycap 102. The two locking parts 1062 of the stabilizer bar 106 are respectively engaged with the first hook 1011 and the second hook 1012 of the base plate 101. Consequently, the stabilizer bar 106 is connected between the keycap 102 and the base plate 101.

Please refer to FIGS. 3, 4 and 6 again. In an embodiment, the base plate 102 further comprises a third hook 1013 and a fourth hook 1014. The connecting member 104 is connected with the base plate 101 through the third hook 1013 and the fourth hook 1014 of the base plate 101. It is noted that the way of connecting the connecting member 104 with the base plate 101 is not restricted. Preferably but not exclusively, the keycap 102 comprises plural second pivotal parts 1024. In addition, the connecting member 104 is pivotally coupled to the keycap 102 through the plural second pivotal parts 1024 of the keycap 102. Preferably but not exclusively, the connecting member 104 is a scissors-type connecting member. The operations of the connecting member 104 are similar to those of the conventional technology, and not redundantly described herein.

Please refer to FIGS. 3, 4 and 6 again. In an embodiment, the membrane circuit board 103 comprises plural openings 1030. The number of the openings 1030 is not restricted. The connecting member 104 is penetrated through the corresponding openings 1030 and connected between the keycap 102 and the base plate 101. Moreover, a membrane switch (not shown) is installed on the membrane circuit board 103. While the keycap 102 is moved downwardly relative to the membrane circuit board 103 through the connecting member 104, the elastic element 105 is pushed by the pressing post 1020 of the keycap 102 and subjected to deformation. Consequently, the membrane switch on the membrane circuit board 103 is triggered to generate a corresponding key signal.

Please refer to FIGS. 3, 4, 5 and 6. In an embodiment, each supporting rib 1052 of the elastic element 105 comprises a supporting part 10521 and a carrying part 10522. The supporting part 10521 of the supporting rib 1052 is connected between the resilience piece 1051 and the carrying part 10522 of the supporting rib 1052. The carrying part 10522 of the supporting rib 1052 is arranged between the pressing post 1020 of the keycap 102 and the resilience piece 1051. The carrying part 10522 is used for supporting the pressing post 1020 of the keycap 102. That is, when the key structure 10 is not pressed down, the pressing post 1020 of the keycap 102 is supported by the plural supporting ribs 1052. Consequently, the gap G between the pressing post 1020 of the keycap 102 and the resilience piece 1051 of the elastic element 105 can be maintained.

In an embodiment, the supporting ribs 1052 and the resilience piece 1051 are integrally formed. For example, after the main portions of the supporting ribs 1052 are formed on the resilience piece 1051 by a stamping process and bent upwardly, the supporting ribs 1052 are formed. It is noted that the method of forming the supporting ribs 1052 is not restricted. For example, in another embodiment, the supporting ribs 1052 and the resilience piece 1051 are individual components.

In an embodiment, the resilience piece 1051 has a semi-spheric shell structure (e.g., a snap dome structure). When the resilience piece 1051 is subjected to deformation, the membrane switch on the membrane circuit board 103 is triggered and electrically conducted. Moreover, the semi-spheric shell structure of the resilience piece 1051 has a cavity 10510 facing the membrane circuit board 103. When the resilience piece 1051 is subjected to deformation in response to the elastic force, the cavity 10510 provides a sufficient deformable space of the resilience piece 1051.

Please refer to FIG. 6. When the keycap 102 is not pressed, the pressing post 1020 of the keycap 102 is carried by the carrying parts 10522 of the plural supporting ribs 1052 of the elastic element 105. Consequently, there is the gap G between the pressing post 1020 of the keycap 102 and the resilience piece 1051 of the elastic element 105, and the keycap 102 is positioned in a first position P1.

Please refer to FIG. 6. While the keycap 102 is pressed down in response to the external force, the pressing post 1020 of the keycap 102 is moved downwardly to push the plural supporting ribs 1052 of the elastic element 105. After the plural supporting ribs 1052 of the elastic element 105 are pushed, the supporting parts 10521 and the carrying parts 10522 are all subjected to deformation and moved toward the resilience piece 1051 until these supporting ribs 1052 are contacted with the top surface of the resilience piece 1051. While these supporting ribs 1052 are subjected to deformation, the keycap 102 is moved in the direction toward the membrane circuit board 103 and moved from the first position P1 to a second position P2. Meanwhile, the membrane switch (not shown) on the membrane circuit board 103 has not been triggered. Since the path of moving the keycap 102 from the first position P1 to the second position P2 is an empty travel distance for providing a buffering effect, the tactile feel of pressing the keycap 102 is satisfactory to the user.

As the keycap 102 is continuously pressed in response to the external force, the resilience piece 1051 of the elastic element 105 is continuously pushed by the pressing post 1020 of the keycap 102. After the resilience piece 1051 of the elastic element 105 is pushed, the resilience piece 1051 with the semi-spheric shell structure is subjected to inwardly concave deformation until the membrane switch (not shown) on the membrane circuit board 103 is triggered by the resilience piece 1051. While the resilience piece 1051 with the semi-spheric shell structure is subjected to the inwardly concave deformation, the keycap 102 is moved in the direction toward the membrane circuit board 103 and moved from the second position P2 to a third position P3.

In the above embodiment, the elastic element 105 comprises four supporting ribs 1052. The four supporting ribs 1052 face each other in pairs. That is, the four supporting ribs are divided into two groups, and the two supporting ribs 1052 in each group face each other. Moreover, the four supporting ribs are discretely arranged on the edges of the resilience piece 1051. It is noted that the number of the supporting ribs 1052 is not restricted. The number of the supporting ribs 1052 may be increased or decreased according to the practical requirements. For example, in case that the lighter tactile feel is required, only two supporting ribs 1052 installed on the resilience piece 1051 are feasible. That is, the two supporting ribs 1052 are installed on two opposite edges of the resilience piece 1051. Whereas, in case that the heavier tactile feel is required, the number of the supporting ribs 1052 on the resilience piece 1051 may be increased to six.

From the above descriptions, the present invention provides the keyboard device. The elastic element of each key structure is equipped with plural supporting ribs for supporting the keycap. Consequently, the travel distance of moving the keycap in the direction toward the membrane circuit board is increased. Moreover, while the keycap is moved downwardly, an empty travel distance is generated to provide a buffering effect. Consequently, the tactile feel of depressing the key structure is satisfactory to the user. In comparison with the conventional technology of using the elastic element with small volume or thickness, the tactile feel of operating the key structure of the present invention is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

The invention claimed is:

1. A keyboard device comprising plural key structures, each of the plural key structures comprising:

a base plate;

a keycap located over the base plate, wherein the keycap comprises a pressing post, and the pressing post is protruded in a direction toward the base plate;

a membrane circuit board arranged between the base plate and the keycap;

a connecting member penetrated through the membrane circuit board and connected between the keycap and the base plate, wherein the keycap is movable upwardly or downwardly relative to the membrane circuit board through movement of the connecting member; and an elastic element arranged between the keycap and the membrane circuit board, and comprising a resilience piece and plural supporting ribs, wherein the resilience piece of the elastic element has a semi-spheric shell structure, and the semi-spheric shell structure has a cavity facing the membrane circuit board and the plural supporting ribs are arranged between the resilience piece and the keycap, and the plural supporting ribs are formed on the semi-spheric shell structure of the resilience piece and protruded in a direction toward the keycap and contacted with the pressing post of the keycap, so that there is a gap between the pressing post and the resilience piece.

2. The keyboard device according to claim 1, wherein the plural supporting ribs of the elastic element comprise two supporting ribs, and the two supporting ribs are located at two opposite sides of the resilience piece.

3. The keyboard device according to claim 1, wherein the plural supporting ribs of the elastic element comprise four supporting ribs, wherein the four supporting ribs face each other in pairs, and the four supporting ribs are discretely arranged on edges of the resilience piece.

4. The keyboard device according to claim 1, wherein each of the plural supporting ribs of the elastic element comprises a supporting part and a carrying part, wherein the supporting part is connected between the resilience piece and the carrying part, the carrying part is arranged between the pressing post of the keycap and the resilience piece, and the pressing post of the keycap is carried by the carrying part.

5. The keyboard device according to claim 1, wherein the plural supporting ribs of the elastic element are integrally formed with the resilience piece, and each of the plural supporting ribs are bent upwardly from a portion of the resilience piece.

6. The keyboard device according to claim 1, wherein the keycap comprises a top wall and a skirt part, wherein the skirt part is protruded from a periphery region of the top wall in a direction toward the membrane circuit board, and the pressing post of the keycap is installed on an inner surface of the top wall.

7. The keyboard device according to claim 1, wherein the key structure further comprises a stabilizer bar, and the stabilizer bar comprises a transverse bar part and two locking parts, wherein the two locking parts are respectively located at two ends of the transverse bar part, the transverse bar part is pivotally coupled to the keycap, and the two locking parts are connected with the base plate.

8. The keyboard device according to claim 1, wherein while the keycap is pressed down in response to an external force, the pressing post is moved downwardly to push the plural supporting ribs of the elastic element, and the plural supporting ribs are subjected to deformation, so that the keycap is moved toward the membrane circuit board and moved from a first position to a second position.

9. The keyboard device according to claim 8, wherein as the keycap is continuously pressed in response to the external force, the resilience piece of the elastic element is continuously pushed by the pressing post, and the resilience piece is subjected to deformation, so that the keycap is moved toward the membrane circuit board and moved from the second position to a third position.

10. A key structure, comprising:

a base plate;

a keycap located over the base plate, wherein the keycap comprises a pressing post, and the pressing post is protruded in a direction toward the base plate;

a membrane circuit board arranged between the base plate and the keycap;

a connecting member penetrated through the membrane circuit board and connected between the keycap and the base plate, wherein the keycap is movable upwardly or downwardly relative to the membrane circuit board through movement of the connecting member; and an elastic element arranged between the keycap and the membrane circuit board, and comprising a resilience piece and plural supporting ribs, wherein the resilience piece of the elastic element has a semi-spheric shell structure, and the semi-spheric shell structure has a cavity facing the membrane circuit board and the plural supporting ribs are arranged between the resilience piece and the keycap, and the plural supporting ribs are formed on the semi-spheric shell structure of the resilience piece and protruded in a direction toward the keycap and contacted with the pressing post of the keycap, so that there is a gap between the pressing post and the resilience piece.

* * * * *